US006802285B2

(12) United States Patent
Hefler

(10) Patent No.: US 6,802,285 B2
(45) Date of Patent: Oct. 12, 2004

(54) ENGINE HAVING A VARIABLE VALVE ACTUATION SYSTEM

(75) Inventor: Gregory W. Hefler, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/324,049

(22) Filed: Dec. 18, 2002

(65) Prior Publication Data

US 2004/0118368 A1 Jun. 24, 2004

(51) Int. Cl.[7] ..... F01L 9/02
(52) U.S. Cl. ..... 123/90.13; 123/90.12
(58) Field of Search ..... 123/90.12, 90.13, 123/90.22

(56) References Cited

U.S. PATENT DOCUMENTS 5,036,810 A 8/1991 Meneely 5,829,397 A * 11/1998 Vorih et al. ..... 123/90.12

* cited by examiner

*Primary Examiner*—Thomas Denion
*Assistant Examiner*—Zelalem Eshete
(74) *Attorney, Agent, or Firm*—Jason J Stanley

(57) ABSTRACT

An engine has a cylinder head having a first surface and a second surface spaced from the first surface. A valve is moveably connected to the cylinder head. A rocker arm is connected to the valve, and a rocker shaft having a first location spaced a maximum distance from the cylinder head is connected to the rocker arm. A support member has and an actuator fluid passage network. The actuator fluid passage network defines a volume. The support member is connected to the cylinder head and is positioned such that a majority of the volume of the actuator fluid passage network is between the first location of the rocker shaft and the second surface of the cylinder head.

8 Claims, 5 Drawing Sheets

ENGINE HAVING A VARIABLE VALVE ACTUATION SYSTEM

GOVERNMENT RIGHTS

This invention was made with Government support under DE-FC05-97OR22605 awarded by DOE. The Government has certain rights in this invention.

TECHNICAL FIELD

This invention relates generally to engines, and more particularly to a variable valve actuation system for an engine.

BACKGROUND

An internal combustion engine typically includes a series of valves that are configured to control the intake and exhaust of gases to and from the engine. A typical engine will include at least one intake valve and at least one exhaust valve for each combustion chamber in the engine. The opening of each valve is typically timed to occur at a certain point in the operating cycle of the engine. For example, an intake valve may be opened when a piston is moving towards a bottom dead center position within a cylinder to allow fresh air to enter the combustion chamber. An exhaust valve may be opened when the piston is moving towards a top dead center position in the cylinder to expel exhaust gas from the combustion chamber.

The efficiency and emission generation characteristics of the engine may be improved by varying the actuation timing of the intake and/or exhaust valves to meet different engine operating conditions. For example, when the vehicle is reducing speed, the exhaust valve actuation timing may be varied to implement an "engine braking" cycle. Engine braking involves opening the exhaust valves when the piston is approaching the top dead center position of a compression stroke to release compressed gas from the combustion chamber instead of inducing combustion. In this manner, the kinetic energy of the moving vehicle may be dissipated by compressing the gas in the compression chamber, which results in a slowing, or "braking," of the engine.

The actuation timing of the intake valves may also be varied to improve the performance of the engine when the engine is experiencing certain operating conditions. For example, a "late intake Miller cycle" may be implemented when the engine is experiencing steady state conditions. A late intake Miller cycle involves holding the intake valves open as the piston moves through an intake stroke and for a first portion of the compression stroke. The late intake Miller cycle may lead to improved engine efficiency and/or reduced emission generation.

To obtain these types of improvements in engine performance, the engine requires a valve actuation system that adjusts the valve actuation timing based on the current operating conditions of the engine. For example, when it is determined that the engine is operating in steady state conditions, the valve actuation system may vary the actuation timing of the intake valves to implement the late intake Miller cycle. Because the engine operating conditions may change frequently, the valve actuation system should be capable of quickly responding and varying the valve actuation timing to meet the current engine operating conditions.

Engine valves are typically actuated by either a cam driven system or a hydraulic system. In a conventional cam driven system, a cam having one or more cam lobes is rotated in conjunction with the engine crankshaft to actuate the engine valves. The shape of the cam lobes determines the valve actuation timing. This type of system is relatively inflexible as the timing of the engine valves will remain constant regardless of the vehicle operating conditions.

In a hydraulic system, a pressurized fluid is used to actuate the engine valves. A hydraulically driven system is typically more flexible than a cam driven system because the actuation timing of a hydraulic system is independent of crankshaft rotation. However, a hydraulic system typically requires additional components, such as a high pressure pump and a complex control system. These additional components may significantly increase the cost of the valve actuation system and the amount of maintenance required on the engine.

A valve actuation system may use a combination of cams and hydraulics that allow the valve actuation timing to be varied in response to different operating conditions. For example, the valve actuation system in U.S. Pat. No. 5,036,810 issued to Meneely on Aug. 6, 1991 combines a cam-driven rocker arm and a hydraulic system to effectuate engine braking. However, in this system the hydraulic components of the valve actuation system, including the passages supplying actuator fluid, are located above the rocker arm of the engine. This placement of the valve actuation components adds height to the engine. Therefore, such a system of valve actuation cannot be used on engines that have tight packaging constraints, such as light duty truck engines. In addition, systems with actuator fluid passages positioned above the rocker shaft often face problems in cold start conditions due to the viscosity of the actuator fluid. Because the actuator fluid is spaced from the heat-producing elements of the engine, in cold conditions the actuator fluid does not reach a satisfactory temperature in an appropriate time frame.

The engine valve actuation system of the present invention solves one or more of the problems set forth above.

SUMMARY OF THE INVENTION

An engine has a cylinder head having a first surface and a second surface spaced from the first surface. A valve is moveably connected to the cylinder head. A rocker arm is connected to the valve, and a rocker shaft having a first location spaced a maximum distance from the cylinder head is connected to the rocker arm. A support member has an actuator fluid passage network. The actuator fluid passage network defines a volume. The support member is positioned such that a majority of the volume of the actuator fluid passage network is between the first location of the rocker shaft and the second surface of the cylinder head.

A support member has a base. The base defines an actuator fluid passage network. The base is dimensioned to fit between a rocker shaft and a cylinder head of an engine.

An engine has a cylinder head having a first surface and a second surface spaced from the first surface. A valve is moveably connected to the cylinder head. A rocker arm is connected to the valve. The engine has a valve cover connected to the cylinder head. The valve cover has a first surface spaced no more than 3.5 inches (88.9) from the second surface of the cylinder head. A variable valve actuation means is connected to the rocker arm and is positioned between the second surface of the cylinder head and the first surface of the valve cover.

A method of assembling an engine includes providing an engine block and attaching a cylinder head to the engine block. The cylinder head has a first surface and a second surface spaced from the first surface. The method includes connecting a rocker shaft to a support member. The support member has an actuator fluid passage network. The actuator fluid passage network has a volume. The method includes connecting the variable valve actuation system to the cylinder head such that a majority of the volume of the actuator fluid passage network is located between the second surface of the cylinder head and a first location of the rocker shaft located a maximum distance from the cylinder head.

DETAILED DESCRIPTION

Figure 1:
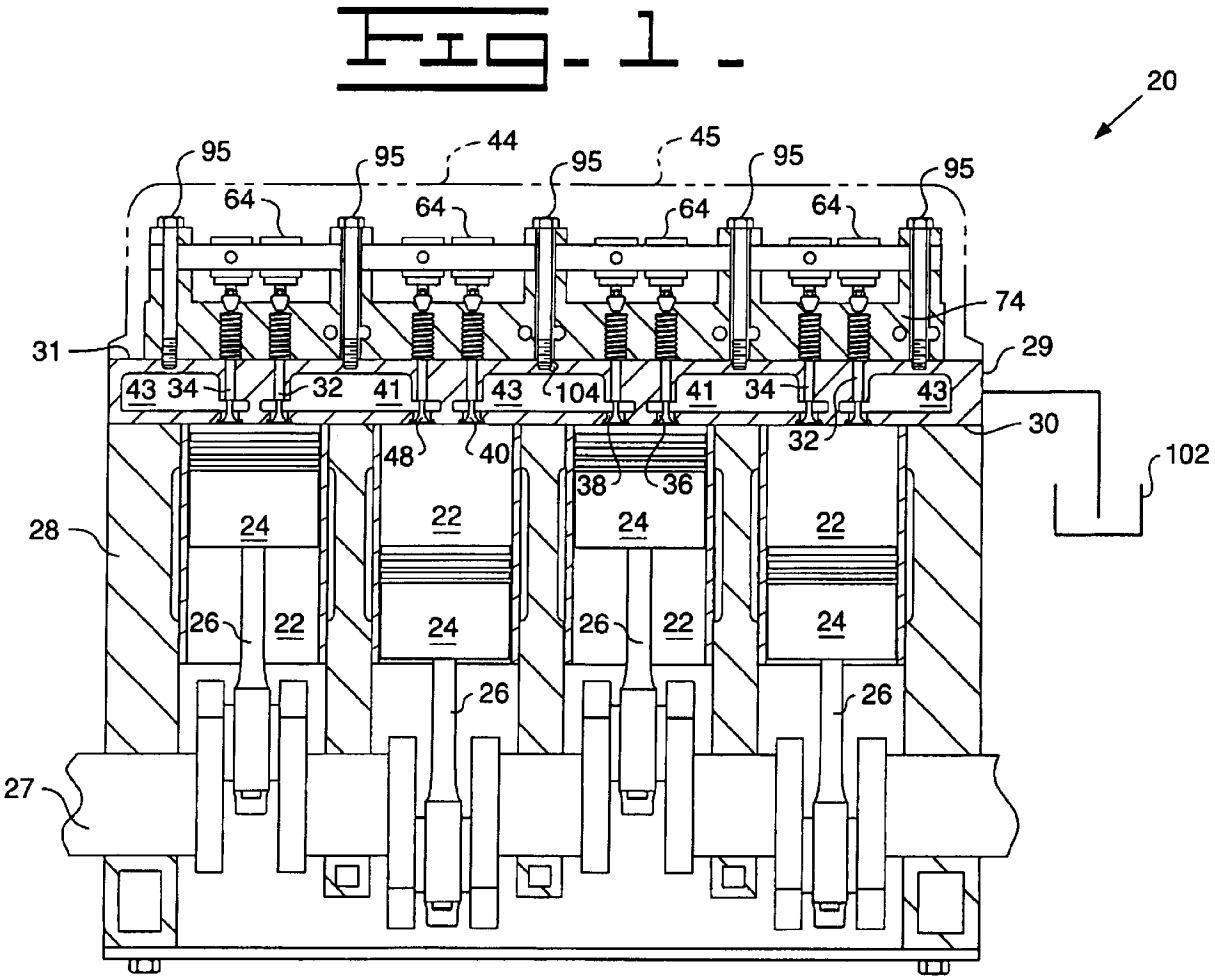
FIG. 1 is a cross-sectional view of an engine.

An exemplary embodiment of an internal combustion engine 20 is illustrated in FIG. 1. For the purposes of the present disclosure, engine 20 is depicted and described as a four stroke diesel engine. One skilled in the art will recognize, however, that engine 20 may be any other type of internal combustion engine, such as, for example, a gasoline or natural gas engine.

As illustrated in FIG. 1, engine 20 includes an engine block 28 that defines a plurality of cylinders 22. A piston 24 is slidably disposed within each cylinder 22. In the illustrated embodiment, engine 20 includes four cylinders 22 and four associated pistons 24. One skilled in the art will readily recognize that engine 20 may include a greater or lesser number of pistons 24 and that pistons 24 may be disposed in an "in-line" configuration, a "V" configuration, or any other conventional configuration.

As also shown in FIG. 1, engine 20 includes a crankshaft 27 that is rotatably disposed within engine block 28. A connecting rod 26 connects each piston 24 to crankshaft 27. Each piston 24 is coupled to crankshaft 27 so that a sliding motion of piston 24 within the respective cylinder 22 results in a rotation of crankshaft 27. Similarly, a rotation of crankshaft 27 will result in a sliding motion of piston 24.

Engine 20 also includes a cylinder head 29. Cylinder head 29 has a first surface 30 connected to the engine block 28 and a second surface 31 spaced from first surface 30. Cylinder head 29 defines an intake passageway 41 that leads to at least one intake port 36 for each cylinder 22. Cylinder head 29 may further define two or more intake ports 36 for each cylinder 22.

An intake valve 32 is moveably connected to cylinder head 29. Intake valve 32 is disposed within intake port 36. Intake valve 32 includes a valve element 40 that is configured to selectively block intake port 36. As described in greater detail below, each intake valve 32 may be actuated to move or "lift" valve element 40 to thereby open the respective intake port 36. In a cylinder 22 having a pair of intake ports 36 and a pair of intake valves 32, the pair of intake valves 32 may be actuated by a single valve actuation assembly or by a pair of valve actuation assemblies.

Cylinder head 29 also defines at least one exhaust port 38 for each cylinder 22. Each exhaust port 38 leads from the respective cylinder 22 to an exhaust passageway 43. Cylinder head 29 may further define two or more exhaust ports 38 for each cylinder 22.

An exhaust valve 34 is moveably connected to cylinder head 29. Exhaust valve 34 is disposed within exhaust port 38. Exhaust valve 34 includes a valve element 48 that is configured to selectively block exhaust port 38. As described in greater detail below, each exhaust valve 34 may be actuated to move or "lift" valve element 48 to thereby open the respective exhaust port 38. In a cylinder 22 having a pair of exhaust ports 38 and a pair of exhaust valves 34, the pair of exhaust valves 34 may be actuated by a single valve actuation assembly or by a pair of valve actuation assemblies.

Engine 20 has a valve cover 44 connected to cylinder 29. Valve cover 44 has a first surface 45 spaced a defined distance from second surface 31 of cylinder head 29. In one embodiment the defined distance from first surface 45 of valve cover 44 to second surface 31 of cylinder head 29 is not more than 3.5 inches (88.9 mm). Currently known variable valve actuation systems may not be usable on such an embodiment because the systems may not fit between the cylinder head 29 and the valve cover 44.

Figure 2:
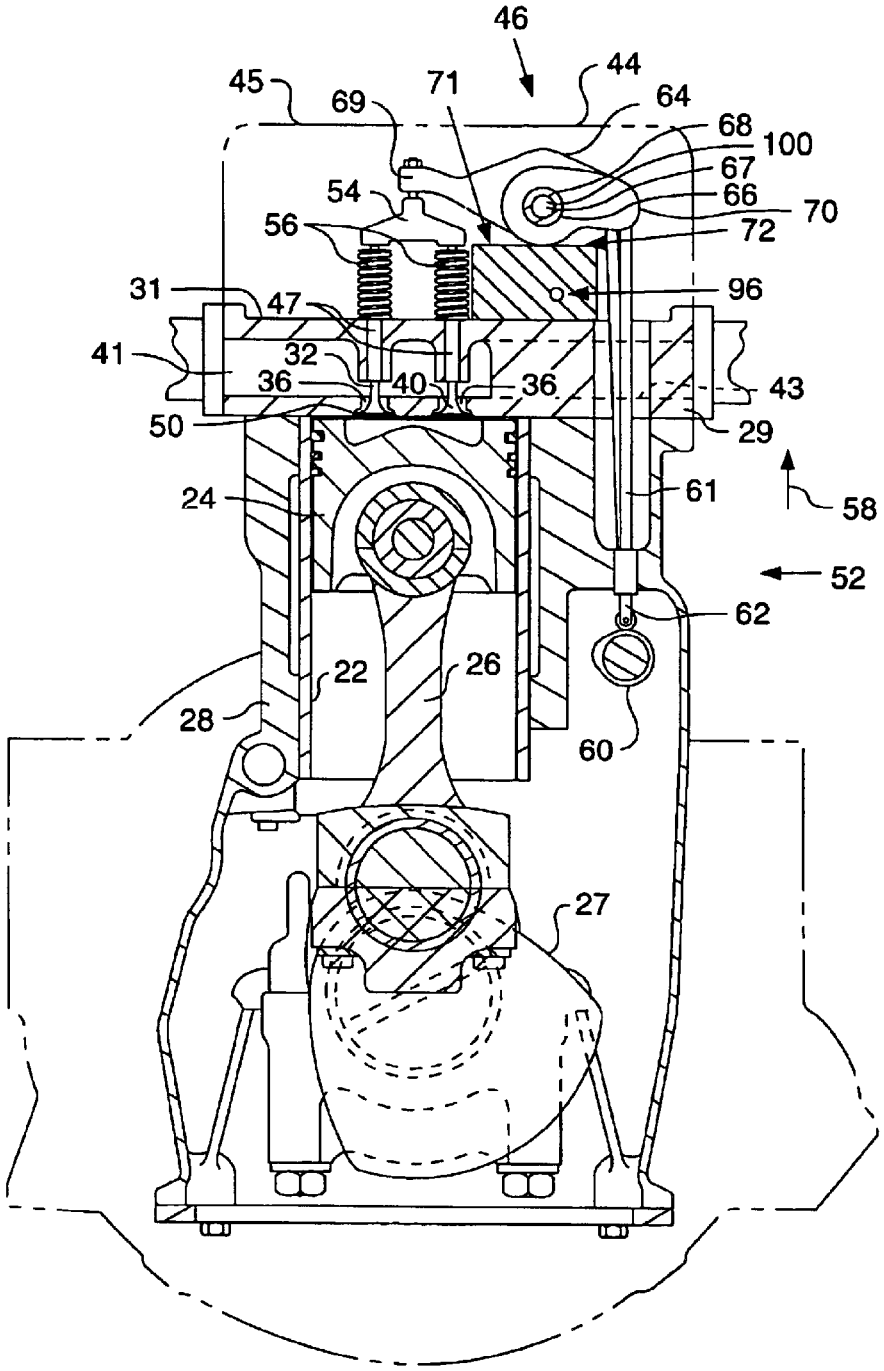
FIG. 2 is a cross-sectional view of the engine of taken along line 2—2 of FIG. 1.

FIG. 2 illustrates an exemplary embodiment of one cylinder 22 of engine 20. As shown, cylinder head 29 defines a pair of intake ports 36 connecting intake passageway 41 to cylinder 22. Each intake port 36 includes a valve seat 50. One intake valve 32 is disposed within each intake port 36. Valve element 40 of intake valve 32 is configured to engage valve seat 50. When intake valve 32 is in a closed position, valve element 40 engages valve seat 50 to close intake port 36 and blocks fluid flow relative to cylinder 22. When intake valve 32 is lifted from the closed position, intake valve 32 allows a flow of fluid relative to cylinder 22.

Similarly, cylinder head 29 may define two or more exhaust ports 38 (only one of which is illustrated in FIG. 1) that connect cylinder 22 with exhaust passageway 43. One exhaust valve 34 is disposed within each exhaust port 38. A valve element 48 of each exhaust valve 34 is configured to close exhaust port 38 when exhaust valve 34 is in a closed position and block fluid flow relative to cylinder 22. When exhaust valve 34 is lifted from the closed position, exhaust valve 34 allows a flow of fluid relative to cylinder 22.

As also shown in FIG. 2, a valve actuation assembly 46 is operatively associated with intake valves 32. Valve actuation assembly 46 includes a bridge 54 that is connected to each valve element 40 through a pair of valve stems 46. A spring 56 may be disposed around each valve stem 47 between cylinder head 29 and bridge 54. Spring 56 acts to bias both valve elements 40 into engagement with the respective valve seat 50 to thereby close each intake port 36.

Valve actuation assembly 46 also includes a rocker arm 64. Rocker arm 64 is configured to pivot about a rocker shaft 66. Rocker shaft 66 defines a bore 67. Rocker shaft 66 has a first location 68 spaced a maximum distance from cylinder head 29. A first end 69 of rocker arm 64 is connected to bridge 54. A second end 70 of rocker arm 64 is connected to a cam assembly 52. In the exemplary embodiment of FIG. 2, cam assembly 52 includes a cam 60 having a cam lobe and mounted on a cam shaft, a push rod 61, and a cam follower 62. One skilled in the art will recognize that cam assembly 52 may have other configurations, such as, for example, where cam 60 acts directly on rocker arm 64.

Valve actuation assembly 46 may be driven by cam 60. Cam 60 is connected to crankshaft 27 so that a rotation of crankshaft 27 induces a corresponding rotation of cam 60. Cam 60 may be connected to crankshaft 27 through any means readily apparent to one skilled in the art, such as, for example, through a gear reduction assembly (not shown). As one skilled in the art will recognize, a rotation of cam 60 will cause cam follower 62 and associated push rod 61 to periodically reciprocate between an upper and a lower position.

The reciprocating movement of push rod 61 causes rocker arm 64 to pivot about rocker shaft 66. When push rod 61 moves in the direction indicated by arrow 58, rocker arm 64 will pivot and move bridge 54 in the opposite direction. The movement of bridge 54 causes each intake valve 32 to lift and open intake ports 36. As cam 60 continues to rotate, springs 56 will act on bridge 54 to return each intake valve 32 to the closed position.

In this manner, the shape and orientation of cam 60 controls the timing of the actuation of intake valves 32. As one skilled in the art will recognize, cam 60 may be configured to coordinate the actuation of intake valves 32 with the movement of piston 24. For example, intake valves 32 may be actuated to open intake ports 36 when piston 24 is withdrawing within cylinder 22 to allow air to flow from intake passageway 41 into cylinder 22.

A similar valve actuation assembly may be connected to exhaust valves 34. A second cam (not shown) may be connected to crankshaft 27 to control the actuation timing of exhaust valves 34. Exhaust valves 34 may be actuated to open exhaust ports 38 when piston 24 is advancing within cylinder 22 to allow exhaust to flow from cylinder 22 into exhaust passageway 43.

Figure 3:
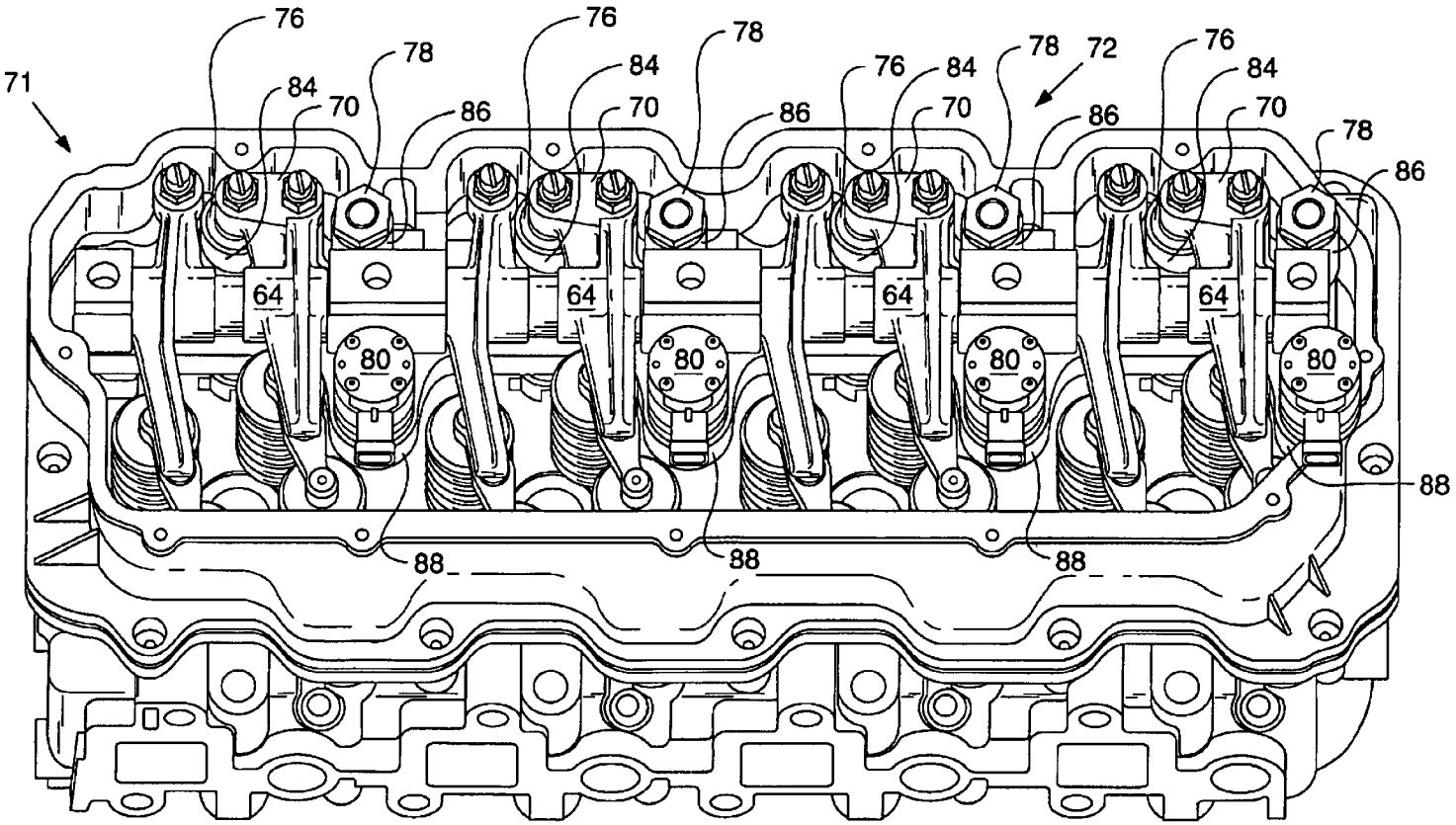
FIG. 3 is a perspective view of the engine.
Figure 4:
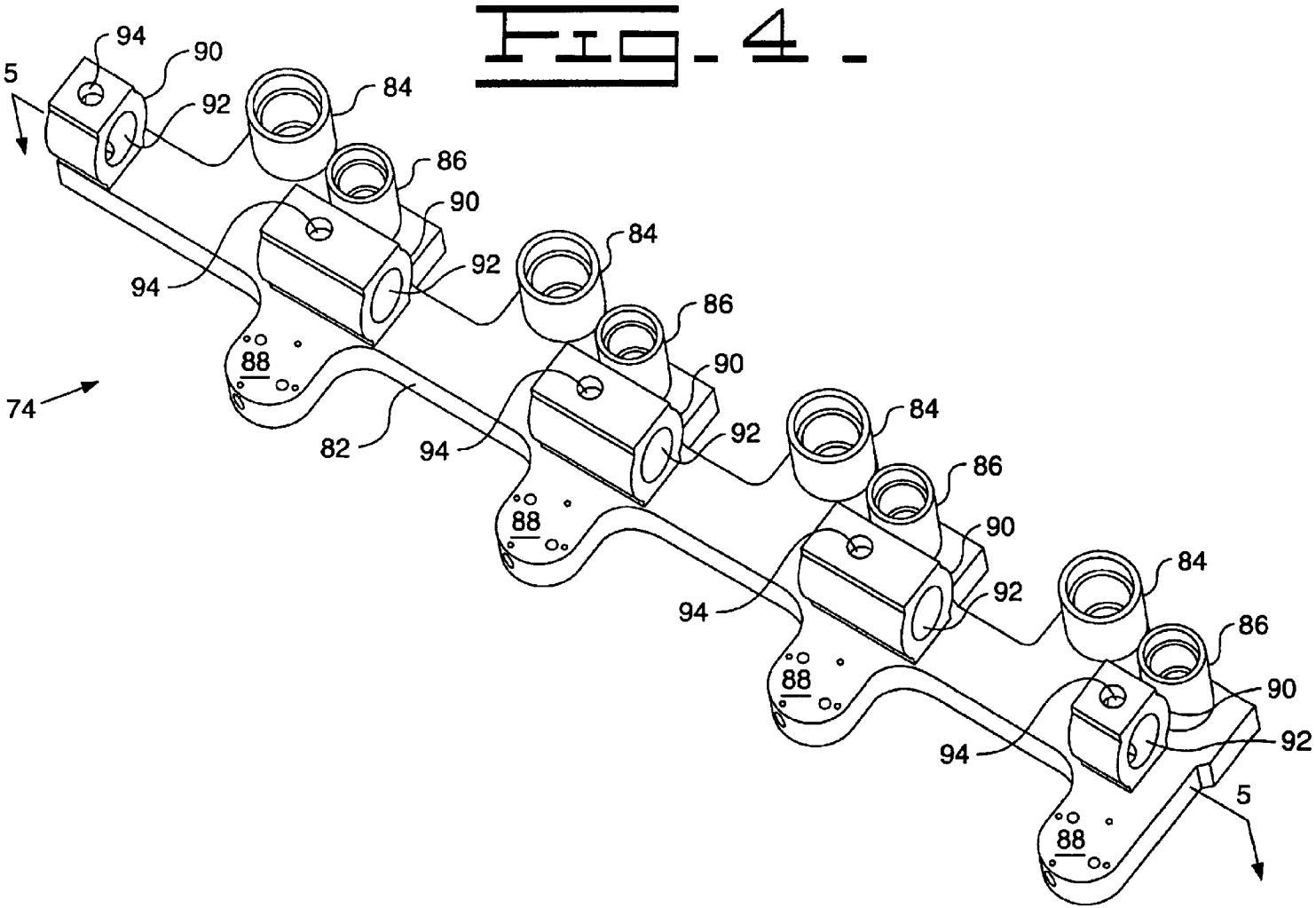
FIG. 4 is a perspective view of a support member of a variable valve actuation system of the engine.

As shown in FIG. 2, valve actuation assembly 46 also includes a variable valve actuation means 71. In the embodiment of FIG. 3, variable valve actuation means 71 is a variable valve actuation system 72 including a support member 74 and a valve actuation device 76. Variable valve actuation system 72 may also include an accumulator 78 and a control valve 80. Support member 74, as shown in FIG. 4, has a base 82. Base 82 is dimensioned to fit between rocker shaft 66 and second surface 31 of cylinder head 29. Support member 74 has four valve actuation device connection zones 84 connected to base 82, four accumulator connection zones 86 connected to base 82, and four control valve connection zones 88 connected to base 82. One skilled in the art will readily recognize that support member 74 may include a greater or lesser number of connection zones, 84, 86, and 88, respectively, depending upon the number of cylinders 22 in engine 20. Support member 74 has five rocker shaft supports 90 connected to base 82. One skilled in the art will readily recognize that support member 74 may include a greater or lesser number of rocker shaft supports 90. Each rocker shaft support 90 has a first bore 92 dimensioned to accept rocker shaft 66. Each rocker shaft support 90 also has a second bore 94 in fluid communication with first bore 92. A bolt, 95 as shown in FIG. 1, is engaged in second bore 94. The bolt passes through rocker shaft 66 and engages cylinder head 29, thereby connecting support member 74 to engine 20.

Figure 5:
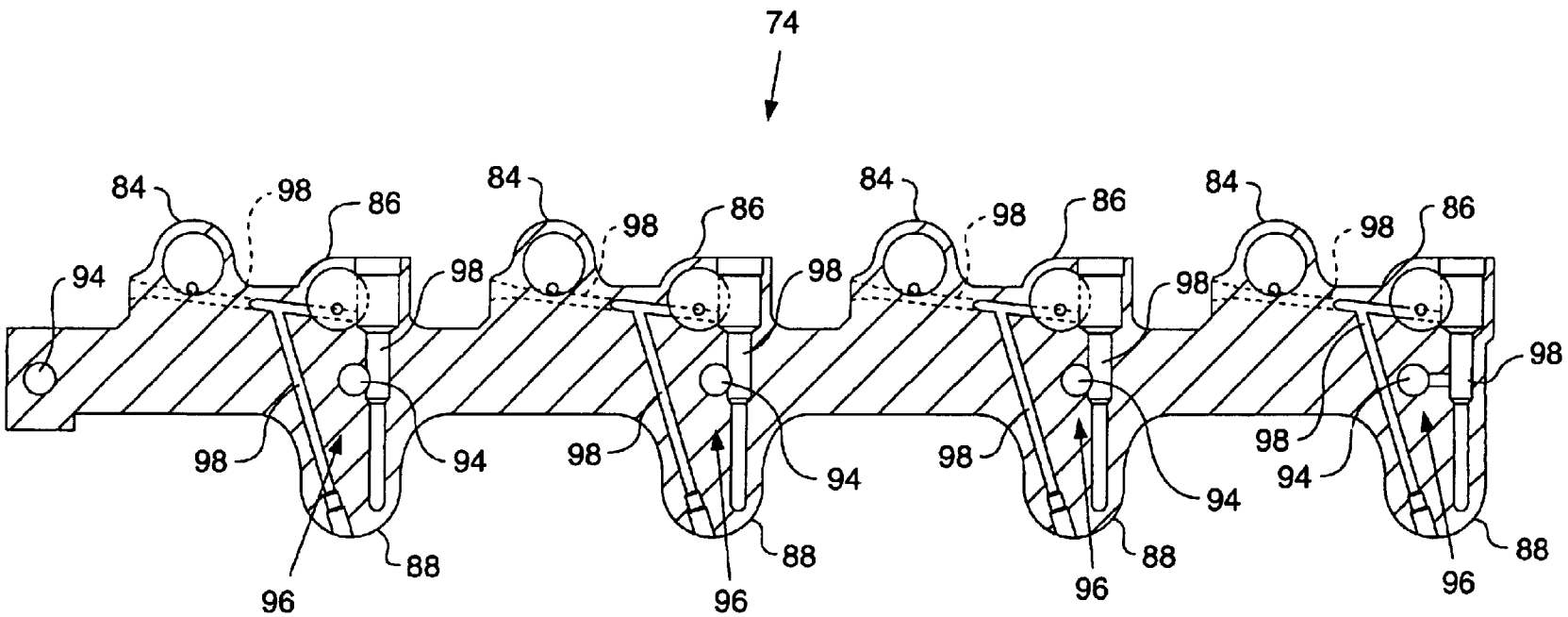
FIG. 5 is a cross-sectional view of the support member taken along line 5—5 of FIG. 4.

As shown in FIG. 5, base 82 of support member 74 defines an actuator fluid passage network 96. Actuator fluid passage network 96 includes passages 98 that are in fluid communication with valve actuation device connection zone 84, accumulator connection zone 86, control valve connection zone 88, and second bore 94 of rocker shaft support 90. Each passage 98 has a defined volume, and the combined volumes of passages 98 define a volume of actuator fluid passage network 96. In the embodiment of FIG. 2, a majority of the volume of actuator fluid passage network 96 is positioned between first location 68 of rocker shaft 66 and second surface 31 of cylinder head 29. In fact, in FIG. 2, substantially all of the volume of actuator fluid passage network 96 is positioned between first location 68 of rocker shaft 66 and second surface 31 of cylinder head 29. Positioning actuator fluid passage network 96 in such a manner aids in reducing the overall size of variable valve actuation system 72, thereby permitting variable valve actuation system 72 to be used on engines with tight packaging restraints. Also, the proximity of actuator fluid passage network 96 to cylinder head 29 allows actuator fluid within actuator fluid passage network 96 to be readily heated by the heat of engine 20, improving the performance of variable valve actuation system 72 in cold-start conditions.

Actuator fluid passage network 96 is adapted to transfer actuator fluid from an actuator fluid source 102 to valve actuation device 76. The actuator fluid used in variable valve actuation system 72 need not be pressurized. Therefore, the actuator fluid may be transferred from the actuator fluid source 102 to the actuator fluid passage network 96 without the use of a high-pressure pump. In the embodiment of FIG. 1, actuator fluid source 102 is in fluid communication with actuator fluid passage network 96 via a passage 104 in cylinder head 29. In FIG. 1, passage 104 is in fluid communication with second bore 94 of rocker shaft support 90, and therefore is in fluid communication with actuator fluid passage network 96. However, one or more passages 104 may be in direct fluid communication with actuator fluid passage network 96. In the embodiment of FIGS. 2 and 5, bore 67 of rocker shaft 66 is an actuator fluid rail 100 and is in fluid communication with second bore 94 of rocker shaft support 92, and therefore is in fluid communication with actuator fluid source 102. Bore 67 of rocker shaft 66 transfers actuator fluid between second bores 94 of rocker shaft supports 90, thereby connecting passages 98 of actuator fluid passage network 96. One skilled in the art will readily recognize that other structures may be used to house actuator fluid rail 100. In addition, a variety of configurations may be used to bring actuator fluid passage network 96 in fluid communication with actuator fluid source 102.

As shown in FIG. 3, valve actuation device 76 is connected to support member 74 at valve actuation device connection zone 84. Valve actuation device 76 is also connected to second end 70 of rocker arm 64. Valve actuation device 76 is configured to move in a direction towards second end 70 of rocker arm 64 and to move in a direction away from second end 70 of rocker arm 64. Valve actuation device 76 is in fluid communication with actuator fluid passage network 96. As discussed in more detail below, actuator fluid passage network 96 provides actuator fluid to cause movement of valve actuation device 76 in the direction towards second end 70 of rocker arm 64.

Accumulator 78 is connected to support member 74 at accumulator connection zone 86. Accumulator 78 is in fluid communication with actuator fluid passage network 96 and, therefore, is in fluid communication with valve actuation device 76. Accumulator 78 acts to dampen oscillations in valve actuation device 76 and actuator fluid passage network 96, which may cause valve actuation device 76 to oscillate.

Control valve 80 is connected to support member 74 at control valve connection zone 88. Control valve 80 is in fluid communication with actuator fluid passage network 96 and, therefore, is in fluid communication with valve actuation device 76 and accumulator 78. Control valve 80 has an open position and a closed position. When control valve 80 is in the open position, valve actuation device 76 is in fluid communication with actuator fluid rail 100. When control valve 80 is in the closed position, valve actuation device 76 is not in fluid communication with actuator fluid rail 100.

A controller (not shown) is connected to each control valve 80. The controller may include an electronic control module that has a microprocessor and a memory. As is known to those skilled in the art, the memory is connected to, the microprocessor and stores an instruction set and variables. Associated with the microprocessor and part of electronic control module are various other known circuits such as, for example, power supply circuitry, signal conditioning circuitry, and solenoid driver circuitry, among others.

The controller may be programmed to control one or more aspects of the operation of engine 20. For example, the controller may be programmed to control the valve actuation assembly, the fuel injection system, and any other function readily apparent to one skilled in the art. The controller may control engine 20 based on, the current operating conditions of the engine and/or instructions received from an operator.

The controller may be further programmed to receive information from one or more sensors operatively connected with engine 20. Each of the sensors may be configured to sense one or more operational parameters of engine 20. For example, engine 20 may be equipped with sensors configured to sense one or more of the following: the temperature of the engine coolant, the temperature of the engine, the ambient air temperature, the engine speed, the load on the engine, and the intake air pressure. Engine 20 may be further equipped with a sensor configured to monitor the crank angle of crankshaft 27 to thereby determine the position of pistons 24 within their respective cylinders 22.

Industrial Applicability

Based on information provided by the engine sensors, the controller may operate each valve actuation assembly 46 to selectively implement a late intake Miller cycle for each cylinder 22 of engine 20. Under normal operating conditions, implementation of the late intake Miller cycle will increase the overall efficiency of the engine 20. Under some operating conditions, such as, for example, when engine 20 is cold, the controller may operate engine 20 on a conventional diesel cycle.

The following discussion describes the implementation of a late intake Miller cycle in a single cylinder 22 of engine 20. One skilled in the art will recognize that the system of the present invention may be used to selectively implement a late intake Miller cycle in all cylinders of engine 22 in the same or a similar manner. In addition, the system of the present invention may be used to implement other valve actuation variations on the conventional diesel cycle, such as, for example, an exhaust Miller cycle.

When engine 20 is operating under normal operating conditions, the controller implements a late intake Miller cycle by selectively actuating valve actuation device 76 to hold intake valve 32 open for a first portion of the compression stroke of piston 24. This may be accomplished by positioning control valve 80 in the open position when piston 24 starts an intake stroke. This allows actuator fluid to flow from actuator fluid source 102 through actuator fluid rail 100 and into actuator fluid passage network 96. The actuator fluid then acts upon valve actuation device 76 so that valve actuation device 76 moves in the direction of second end 70 of rocker arm 64 as rocker arm 64 pivots to open intake valves 32.

When valve actuation device is filled with fluid, the controller may position control valve 80 in the closed position. This prevents fluid from escaping from valve actuation device 76. As cam 60 continues to rotate and springs 56 urge intake valves 32 towards the closed position, valve actuation device will engage second end 70 of rocker arm 64 and prevent intake valves 32 from closing. As long as control valve 80 remains in the closed position, the trapped fluid in valve actuation device 76 will prevent springs 56 from returning intake valves 32 to the closed position. Thus, valve actuation device 76 will hold intake valves 32 in the open position, independently of the action of cam assembly 52.

The controller may close intake valves 32 by placing control valve 80 in the open position. This places valve actuation device 76 in fluid communication with actuator fluid rail 100, and the force of springs 56 forces the fluid from valve actuation device 76. This allows rocker arm 64 to pivot so that intake valves 32 are moved to the closed position.

As noted previously, certain operating conditions may require that engine 20 be operated on a conventional diesel cycle instead of the late intake Miller cycle described above. These types of operating conditions may be experienced, for example, when engine 20 is first starting or is otherwise operating under cold conditions. The described valve actuation system 44 allows for the selective disengagement of the late intake Miller cycle. The controller may disengage the Miller cycle by leaving control valve 80 in the open position. Control valve 80 may be left in the open position when the controller receives sensory input indicating that engine 20 is starting or is operating under cold conditions.

As will be apparent from the foregoing description, the present invention provides an engine valve actuation system that may selectively alter the timing of the intake and/or exhaust valve actuation of an internal combustion engine. The actuation of the engine valves may be based on sensed operating conditions of the engine. For example, the engine valve actuation system may implement a late intake Miller cycle when the engine is operating under normal operating conditions. The late intake Miller cycle may be disengaged when the engine is operating under adverse operating conditions, such as when the engine is cold. Thus, the present invention provides a flexible engine valve actuation system that provides for both enhanced cold starting capability and fuel efficiency gains. The valve actuation assembly of the present invention has a variable valve actuation system that is compact, allowing it to be used on engines having tight packaging constraints, such as light duty truck engines. The proximity of actuation fluid passage network 96 to cylinder head 29 improves the performance of variable valve actuation system 72 during cold-start conditions.

Other aspects, objects, and advantages of this invention can be obtained from a study of the drawings, the disclosure, and the appended claims.

What is claimed is:

1. An engine comprising:

an engine block;

a cylinder head having a first surface connected to said engine block and a second surface spaced from said first surface;

a valve moveably connected to said cylinder head;

a rocker arm connected to said valve;

a cam assembly mechanically connected to said rocker arm;

a rocker shaft connected to said rocker arm, said rocker shaft having a first location spaced a maximum distance from said cylinder head;

a valve actuation device connected to said rocker arm, said valve actuation device spaced apart from said mechanical connection between said cam assembly and said rocker arm; and a support member connected to said cylinder head, said support member having an actuator fluid passage network adapted to transfer actuator fluid from an actuator fluid source to said a valve actuation device, said actuator fluid passage network defining a volume, said support member positioned such that a majority of said volume of said actuator fluid passage network is between said first location of said rocker shaft and said second surface of said cylinder head.

2. The engine of claim 1 wherein said support member includes a base dimensioned to fit between said rocker shaft and said second surface of said cylinder head.

3. The engine of claim 1 wherein said support member includes a rocker shalt support having a first bore, said first bore dimensioned to accept said rocker shaft.

4. The engine of claim 3 wherein said rocker shall support has a second bore, said second bore in fluid communication with said first bore, said second bore in fluid communication with said actuator fluid passage network.

5. The engine of claim 4 wherein said rocker shall is engaged in said first bore of said rocker shaft support, said rocker shaft defines a bore, and said bore of said rocker shaft is in fluid communication with said second bore of said rocker shaft support.

6. The engine of claim 1 wherein said cylinder head has a passage in fluid communication with said actuator fluid source, said passage in fluid communication with said actuator fluid passage network.

7. The engine of claim 1 wherein said valve is an intake valve.

8. The engine of claim 1 wherein said support member is positioned such that substantially all of said volume of said actuator fluid passage network is between said first location of said rocker shaft and said second surface of said cylinder head.

* * * * *

UNITED STATES PATENT AND TRADEMARK OFFICE

CERTIFICATE OF CORRECTION

PATENT NO. : 6,802,285 B2
DATED : October 12, 2004
INVENTOR(S) : Gregory W. Hefler It is certified that error appears in the above-identified patent and that said Letters Patent is hereby corrected as shown below:

Column 9,
Line 14, delete “shalt” and insert -- shaft --
Line 16, delete “shall” and insert -- shaft --

Column 10,
Line 1, delete “shall” and insert -- shaft --

Signed and Sealed this

First Day of February, 2005

JON W. DUDAS
*Director of the United States Patent and Trademark Office*